United States Patent [19]

Bush

[11] Patent Number: 4,577,373

[45] Date of Patent: Mar. 25, 1986

[54] BUTTON COLLET

[75] Inventor: E. Dan Bush, Downers Grove, Ill.

[73] Assignee: Handy Button Machine Company, Melrose Park, Ill.

[21] Appl. No.: 669,472

[22] Filed: Nov. 8, 1984

[51] Int. Cl.[4] ..... A47C 27/00

[52] U.S. Cl. ..... 24/90 B; 24/129 R; 24/102 T

[58] Field of Search ..... 24/90 B, 90 C, 90 E, 24/90.5, 90 R, 102 T, 111, 129 R, 230.5, 230.5 AD, 230.5 TP, 230.5 W; 248/306, 304

[56] References Cited

U.S. PATENT DOCUMENTS

| | | | |
|---|---|---|---|
| 975,323 | 11/1910 | Brown | 24/230.5 |
| 1,959,985 | 5/1934 | Moll | 24/129 X |
| 2,090,779 | 8/1937 | Bechik | 24/102 T |
| 2,892,230 | 6/1959 | Lopez | 24/129 R |
| 3,829,935 | 8/1974 | Critchfield . | |
| 3,908,236 | 9/1975 | Shepherd | 24/90 B |

FOREIGN PATENT DOCUMENTS

| | | | |
|---|---|---|---|
| 622829 | 6/1961 | Canada | 24/90 B |

*Primary Examiner*—Francis K. Zugel
*Assistant Examiner*—Laurie K. Cranmer
*Attorney, Agent, or Firm*—Trexler, Bushnell & Wolters, Ltd.

[57] ABSTRACT

A button collet for a tufting button comprises a one piece resilient plastic body having a projecting stem that includes a shank and a hook for receiving a tufting loop. The stem has shoulders on its opposite sides in the region of juncture of the shank and the hook. When tension is applied to the loop the forces tending to open the hook are resisted by counter forces applied against the shoulders by the loop, thereby effectively increasing the tensile strength of the collet.

9 Claims, 7 Drawing Figures

FIG. 1
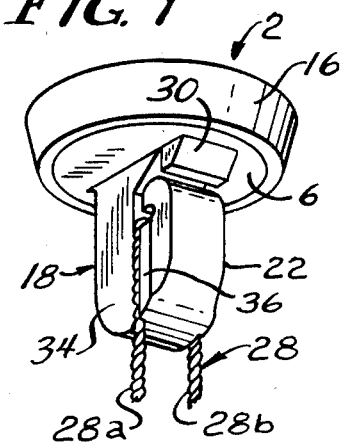
FIG. 2
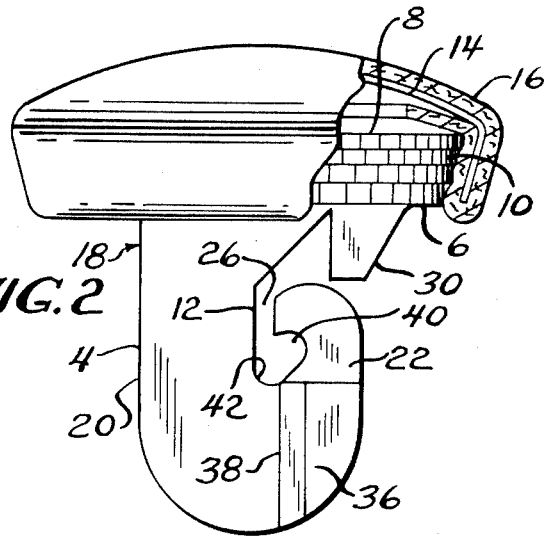
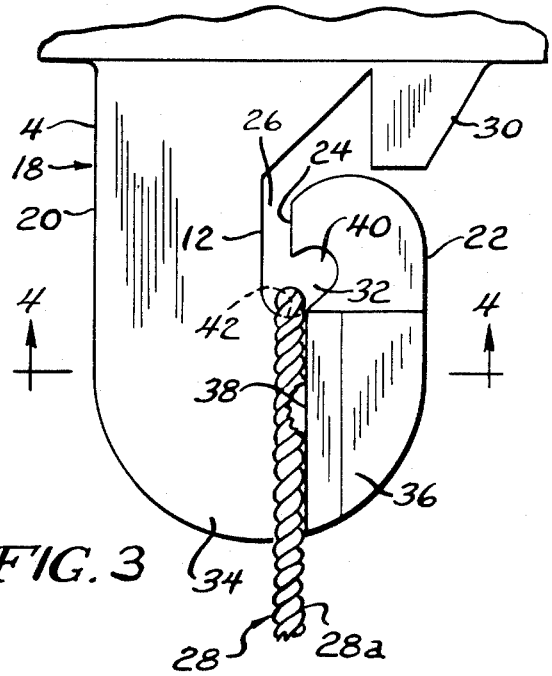
FIG. 3
FIG. 4
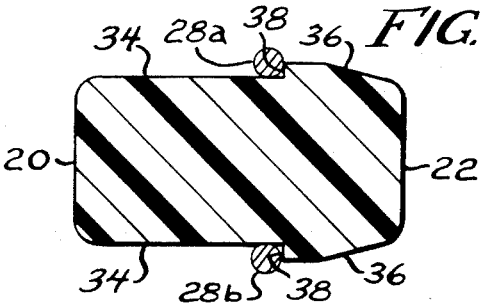
FIG. 5
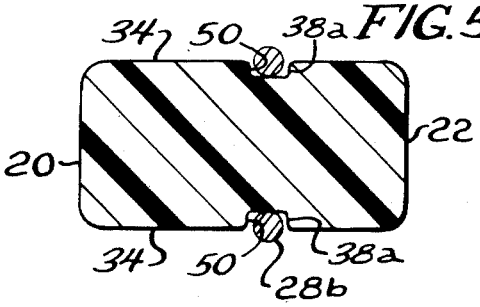
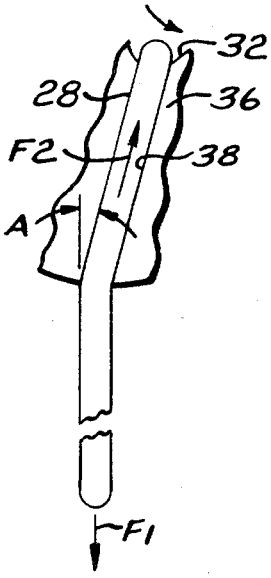
FIG. 6
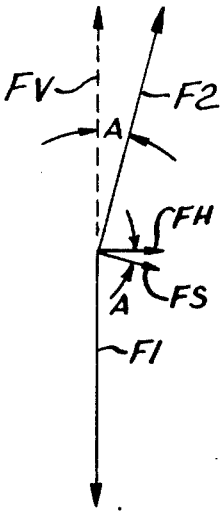
FIG. 7

BUTTON COLLET

BACKGROUND OF THE INVENTION

This invention relates to collets for tufting buttons, and is an improvement over the button collet shown and described in U.S. Pat. No. 3,829,935 to Critchfield that was granted Aug. 20, 1974.

The collet shown and described in the foregoing patent comprises a one piece molded plastic body having a peripheral side over which a button shell with assembled button-covering material is adapted to be crimped. The base of the collet has a stem with a hook for receiving a pre-tied tufting loop which is retained by snap locks so as to prevent removal of the tufting loop. During installation of the tufting button onto the upholstered furniture, the button is drawn into the furniture by the tufting loop. During this procedure and depending upon the depth of tuft and manner of installation, the tufting loop can impose extremely high tensile forces onto the hook. Thus, as the tensile force applied by the loop to the hook increases, the hook will open, resulting in substantial distention, and in many instances the hook will be opened up to the point where failure will occur. This failure generally takes place at the junction of the hook and the hook shank, the latter of which is joined to the base of the collet. Of course, the hook could be reinforced at the normal region of failure, but this tends to increase the size of the hook unduly, which is objectionable from the point of view of the manufacturer of upholstered furniture.

OBJECTS OF THE INVENTION

It is an object of this invention to provide an improved button collet in which the resistance to fracture as a result of tensile forces being applied by the tufting loop is enhanced.

It is a further object of this invention to provide a button collet of the type stated which, in a preferred form of the invention, requires only a slight increase in mass to be added to the collet in order to achieve the increased strength.

It is still another object of this invention to provide a button collet of the type stated which enables the improved collet to be used in applications heretofore not possible, thereby providing new uses for the collet and the shank. These grooves are adapted to receive the segments or lengths respectively of the tufting loop.

BRIEF DESCRIPTION OF THE FIGURES

FIG. 1 is a perspective view of a tufting button having a collet with a hook structure in accordance with the present invention;

FIG. 2 is an enlarged side elevational view of the button, partially broken away and in section;

FIG. 3 is a further enlarged fragmentary elevational view of the button showing the collet in the region of the hook;

FIG. 4 is a sectional view taken along line 4—4 of FIG. 3;

FIG. 5 is a view similar to FIG. 4 but showing a modified form of the invention;

FIG. 6 is a diagrammatic view representing the tensile forces applied to the loop; and FIG. 7 is a vector diagram showing the resolution of forces on the loop and the counter force applied to the hook, which counter force increases the effective strength thereof.

SUMMARY OF THE INVENTION

In accordance with the foregoing objects the invention comprises a button collet for a tufting button and an attached tufting loop, said button collet having a resilient plastic body with a central axis, a base, a peripheral side surrounding said axis and joined to said base, and a structure projecting from said base, said structure comprising a shank and an opposed hook separated from said shank by a gap at the free end of the hook, said shank and hook defining a recess for receiving and retaining the tufting loop, said loop having segments on opposite sides of said structure and lying adjacent to said structure when tensile force is applied to said loop in a general direction away from said base and substantially parallel to or coincident with said axis, thereby to apply forces to said hook tending to rotate the hook in a direction that widens said gap and increases the tensile stress on said structure, characterized by an improvement comprising a shoulder formed on each of said opposite sides and with each shoulder being presented toward one of said tufting loop segments and in pressure engagement therewith when said tensile force is applied, thereby to produce components of forces in said segments which are imposed against said shoulders, said components of force tending to rotate said hook in a counter direction that reduces said gap and said tensile stress.

In one form of the invention the shoulders are formed by ribs molded on opposite sides of the stem and projecting from opposite sides of the hook. In another form of the invention the shoulders are formed by grooves in opposed sides of the stem in the region of juncture of the hook.

DETAILED DESCRIPTION

Referring now in more detail to the drawing, which illustrates a preferred embodiment of the present invention, there is shown a tufting button 2 having a button collet 4 formed of a one piece plastic body of nylon or the like. The body has a base 6, a top 8, and a stepped peripheral side 10 that joins the base and top and surrounds the central axis of the collet. This central axis approximately coincides with a surface 12 (FIG. 3) that constitutes a portion of the stem, to be hereinafter described. Clinched to the peripheral side 10 is a metal button shell 14 around which is wrapped a covering material 16. The assembled covering 16 and metal shell 8 are clinched to the peripheral side wall 10 in a known manner.

A structure in the form of a stem 18 projects from the base 6 approximately centrally thereof and comprises a shank 20 which joins with a hook 22 that terminates in a free end 24 that is spaced from the surface 12 to define a gap 26 through which the tufting loop 28 snap fits.

Also projecting from the base 6 is a tab 30 which cooperates with the adjacent arcuate surface of the hook 22 to provide an additional snap lock through which the loop must pass in order to end up seated in an elongated recess 32. This recess 32 is defined by the shank 20 and the hook 22.

Integrally molded onto the sides 34, 34 of the stem 18 As seen in FIGS. 2 and 3, the shoulders extend from adjacent the hook "bottom" 42 to an outer edge of stem 18. are ribs 36, 36 that form parallel shoulders 38, 38. The ribs 36, 36 may be a maximum thickness at the shoulders 38, 38 and gradually taper down to a minimum dimension at the end of the hook 22 that is remote from said recess 32. The width of each shoulder 38 is such that only a small amount of material need be added to the collet to form the ribs 36, 36. In a typical situation by way of example but not of limitation the tufting loop may be a nylon thread approximately 0.030 inches in transverse dimension or diameter while the width of the shoulders (as seen in FIG. 4) need be only be approximately one half of the diameter with the result that the width of each shoulder is of the order of 0.015 inches.

The tufting loop 28 is assembled with the collet by snapping the tufting loop between the tab 30 and the hook 22 and also snapping the tufting loop through the gap 26 so that the tufting loop may seat in the "bottom" as at 42 of the elongated recess 32. When initial tension is applied to the loop 28 the force will be taken up by the loop segments 28*a*, 28*b* which lie against the respective shoulders 38, 38. As tension is increased in the tufting loop segments 28*a*, 28*b* the applied force tends to rotate the hook 22 in a clockwise direction as viewed from FIG. 3, thereby tending to open the hook. In the absence of the shoulders 38 the hook will tend to continue to open as the tension on the loop increases. Assuming that the loop 28 does not break the hook will continue to bend until the recess portion 40 is slightly below the seat 42. When this condition occurs the loop 28 will tend to move to the right (FIG. 3) and into the recess portion 40 thereby leveraging the tensile force on the loop 28 to the extent of the distance between the recess portions 40, 42. Again, assuming that the loop does not break, the now leveraged forces on the hook will probably cause the hook to rupture, and this rupture will take place usually along some path emanating from the seat 42 downward thereof, as viewed in FIG. 3.

However, the provision of the ribs 36 that form the shoulders 38 results in a structure which enables a counter force to be applied to the hook 22 in opposition to the tensile forces referred to previously. Thus, referring to FIGS. 6 and 7 assume that the force on the tufting loop 28 is F1 and that the reaction force is F2. The applied tensile force F1 has caused the hook to rotate such that the shoulders 38 are shifted from the generally vertical position shown in FIG. 3 to an inclined position shown exaggerated in FIG. 6, the shift or displacement being through an angle A. Under such conditions the segments 28*a*, 28*b* of the loop 28 will apply reaction forces against the respective shoulders 38, 38 tending to rotate the hook 22 in a counterclockwise direction (FIG. 3) to narrow the gap 26.

Referring to FIG. 7 the reaction force F2 will be broken up into a vertical component FV and a horizontal component FH which, in turn, has a component FS that is applied to the shoulders 38 at right angles thereto. More particularly, the component FH=F2 Sine A while the component FS=FH Cos A.

The effect of the shoulders 38, 38 is substantial in preventing an over stress condition for the collet. For example, but not by way of limitation, a nylon loop of approximately 0.030 inches may be used with a presently conventional collet (i.e., not with shoulders) having a diameter at its top 8 of about 0.448 inches. Such a collet is identified as a number 22 hook button available commercially from Handy Button Machine Company, Melrose Park, Ill. U.S.A. The ultimate strength of the nylon loop is in the range of 65 to 75 pounds tension; however, depending upon the method of application and other factors the hook will fail approximately in the range of 40 to 50 pounds. By use of the shoulders 38, 38 the nylon tufting loop will break before ultimate hook failure, thereby effectively increasing the strength of the hook.

As pointed out previously, the added material utilized to form the ribs 36, 36 is exceedingly small since the maximum width of the rib is, for many practical purposes, of the order of 0.015 inches.

In the modified form of the invention shown in FIG. 5 the opposite sides 34, 34 are formed with grooves 50, 50 which receive respective tufting loop segments 28*a*, 28*b*, and the shoulders 38*a*, 38*a* are formed by the walls of the grooves 50 that are presented in a direction toward the stem 20. The depth of the grooves 50, 50 need only be about one half of the transverse dimension or diameter of the tufting loop thread.

The invention is claimed as follows:

1. A button collet for a tufting button in combination with an attached tufting loop, said button collet having a resilient plastic body with a central axis, a base, a peripheral side surrounding said axis and joined to said base, and a structure projecting from said base, said stucture comprising a stem having a shank having opposite side faces and an opposed hook separated from said shank by a gap at the free end of the hook, said shank and hook defining a recess having a bottom portion for receiving and retaining the tufting loop, said loop having segments on opposite sides of said structure and lying adjacent to said structure when tensile force is applied to said loop in a general direction away from said base, thereby to apply forces to said hook tending to rotate the hook in a direction that widens said gap and increases the tensile stress on said structure, characterized by an improvement comprising a shoulder formed on each of said opposite side faces and with each shoulder extending from adjacent said bottom portion to an outer edge of said shank, each said shoulder being adjacent to one of said tufting loop segments and in pressure engagement therewith, said side faces shaped to provide unobstructed engagement of said segments with said shoulders, when said tensile force is applied to said tufting loop and with the shoulders being dimensioned and shaped to retain said segments thereon when said tensile force is applied thereby to produce components of forces in said segments including a component normal to each shoulder, said normal components of force tending to rotate said hook in a counter direction that reduces said gap and said tensile stress.

2. A button collet and tufting loop according to claim 1 in which each shoulder is formed by a rib on one of said opposite sides that projects away from the associated side.

3. A button collet and tufting loop according to claim 1 in which each shoulder is formed by a groove in one of said sides and with the segments being respectively in said grooves.

4. A button collet having a one piece resilient plastic body with a central axis, a base, a peripheral side surrounding said axis and joined to said base, and a stem projecting from said base approximately centrally thereof; said stem comprising a shank and having opposite side faces with an end remote from said base; and opposed hook joined to said remote end I and projecting from there toward said base and terminating in a free end, said hook and stem forming a body portion with a recess having a bottom portion for receiving a tufting loop having segments adapted to lie along opposite sides of said stem when tension I is applied to said segments imposing a force on said stem tending to open said hook, and means forming shoulders at said opposite side faces and with each shoulder extending from adjacent said bottom portion to an outer edge of said body, and each shoulder being positioned in the respective paths in which said segments are adapted to lie, said side faces shaped to provide unobstructed engagement of said segments with said shoulders when said tensile force is applied to said tufting loop and being dimensioned and shaped to engage and retain said segments on said shoulders in such manner that when said tension is applied to the segments, a component of force will be imposed normal to the shoulders tending to close said hook and reduce the stress in the stem.

5. A button collet according to claim 4 in which said shouldes are substantially at the junction of said shank and hook.

6. A button collet according to claim 4 in which said shoulders are formed by ribs integral with said stem.

7. A button collet according to claim 4 in which said shoulders are formed by walls of grooves in said opposite sides.

8. A button collet according to claim 5 in which said shoulders are parallel to each other.

9. A button collet according to claim 8 having a shoulder which is approximately one-half the transverse dimension of the material of the loop.

* * * * *

UNITED STATES PATENT AND TRADEMARK OFFICE

CERTIFICATE OF CORRECTION

PATENT NO. : 4,577,373

DATED : March 25, 1986

INVENTOR(S) : E. Dan Bush

It is certified that error appears in the above-identified patent and that said Letters Patent is hereby corrected as shown below:

Column 2, lines 65-67, please delete "As seen in FIGS. 2 and 3, the shoulders extend from adjacent the hook "bottom" 42 to an outer edge of stem 18.".

Column 2, line 67, after "shoulders 38,38." please insert --As seen in FIGS. 2 and 3, the shoulders extend from adjacent the hook "bottom" 42 to an outer edge of stem 18.--.

Column 4, line 64, delete "I".

Column 5, line 1, delete "I".

Signed and Sealed this

*Second* Day of *September 1986*

[SEAL]

*Attest:*

DONALD J. QUIGG

*Attesting Officer*

*Commissioner of Patents and Trademarks*